US007444712B2

(12) United States Patent
Wiedemann

(10) Patent No.: US 7,444,712 B2
(45) Date of Patent: Nov. 4, 2008

(54) VACUUM CLEANER

(76) Inventor: Thomas Wiedemann, St. Martin Strasse 2/27, 6850 Dornbirn (AT)

( * ) Notice: Subject to any disclaimer, the term of this patent is extended or adjusted under 35 U.S.C. 154(b) by 642 days.

(21) Appl. No.: 11/186,604

(22) Filed: Jul. 20, 2005

(65) Prior Publication Data

US 2006/0016044 A1 Jan. 26, 2006

(30) Foreign Application Priority Data

Jul. 20, 2004 (AT) ..... GM512/2004

(51) Int. Cl.
*A47L 9/12* (2006.01)
*A47L 9/14* (2006.01)

(52) U.S. Cl. ..... 15/347; 15/352; 55/492; 55/498; 55/508; 55/DIG. 3

(58) Field of Classification Search ..... 15/347, 15/352, 412; 55/492, 498, 506, DIG. 3; *A47L 9/12, A47L 9/14*
See application file for complete search history.

(56) References Cited

U.S. PATENT DOCUMENTS 4,278,454 A 7/1981 Nemesi
6,113,663 A * 9/2000 Liu ..... 55/459.1

FOREIGN PATENT DOCUMENTS

| | | |
|---|---|---|
| DE | 34 05 749 | 8/1985 |
| DE | 295 05 149 | 9/1995 |
| DE | 199 15 291 | 10/2000 |
| EP | 0 921 748 | 10/2000 |
| EP | 1 163 873 | 12/2001 |
| FR | 737 874 | 12/1932 |
| GB | 2 377 656 | 1/2003 |

* cited by examiner

*Primary Examiner*—David A Redding
(74) *Attorney, Agent, or Firm*—Friedrich Kueffner

(57) ABSTRACT

A vacuum cleaner has a vacuum cleaner housing and an exchangeable filter with through opening arranged in the housing. A holding arm connected with its upper end to the vacuum cleaner housing penetrates the through opening. A fastening member is detachably connected to the lower end of the holding arm for securing the filter to the holding arm. The lower end of the holding arm has a radial recess, and the fastening member has engagement elements engaging the radial recess when the filter is secured on the holding arm. The engagement elements block removal of the fastening member from the lower end of the holding arm. The fasting member has an actuating ring moveable between a locked position, in which the engagement elements secure the fastening member against removal from the holding arm, and a release position, in which the fastening member is removable from the holding arm.

20 Claims, 6 Drawing Sheets

Fig. 2
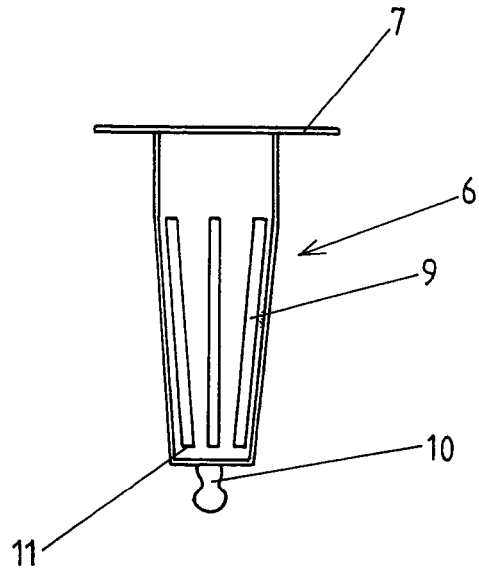
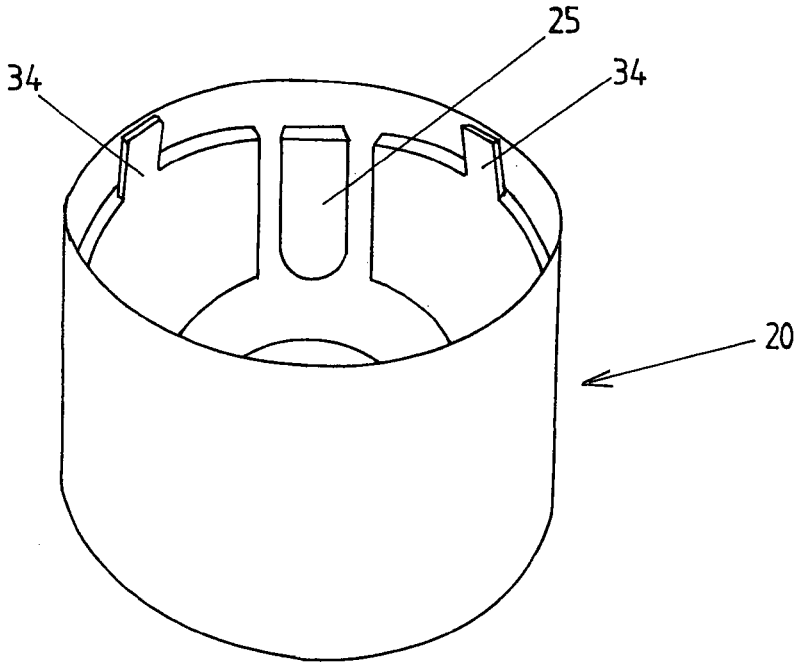
Fig. 5

VACUUM CLEANER

BACKGROUND OF THE INVENTION

1. Field of the Invention

The invention relates to a vacuum cleaner comprising an exchangeable filter arranged within a receiving area of a vacuum cleaner housing. The filter has a through opening through which a holding arm extends for fastening the filter. The holding arm is secured with its upper end on the vacuum cleaner housing or the vacuum cleaner motor. A fastening member for fastening the filter is detachably connectable to the lower end of the holding arm.

2. Description of the Related Art

In vacuum cleaners, in particular, industrial vacuum cleaners and central vacuum cleaning devices, comprising an exchangeable filter that is configured as a cartridge having a central through opening, a fastening device for the exchangeable filter is required. Customarily, a threaded rod is provided for this purpose that is connected with its upper end to the housing or vacuum cleaner motor and extends through the central through opening of the filter, wherein its lower end projects from the through opening. Onto the lower end of the threaded rod a securing plate is pushed that rests against the bottom side of the filter and is secured by means of a knurled nut or wing nut that is screwed onto the threaded rod. A disadvantage of this type of filter attachment is that the exchange of the filter is relatively cumbersome because the knurled nut or wing nut must be unscrewed for this purpose and, after insertion of the new filter, must again be screwed on.

For this reason, there are already filter attachments in use in which a bayonet closure is provided. For this purpose, a bayonet closure member is to be inserted into appropriate recesses at the lower end of the holding arm that penetrates the central through opening of the filter and is to be secured by turning it. In practice, it was found that the user not always complete the turning action required for completely securing the bayonet closure. This has the result that the filter is not reliably fastened and can become detached in operation of the vacuum cleaner. This causes dust to enter the vacuum cleaner motor leading to imbalance that reduces the service life of the vacuum cleaner motor.

Also known are clasp closures in which a clasp is mounted on the lower end of the holding arm that extends through the filter and projects from the through opening and spans the through opening of the filter, wherein the clasp rests against the lower lateral surface of the filter. In the case of such a clasp closure the exchange of the filter is also rather cumbersome.

Plug-in systems have also been proposed in which the filter is frictionally secured on a securing projection that projects from above into the central through opening. A disadvantage is that the risk of detachment of the filter during the course of operation of the vacuum cleaner cannot be reliably excluded.

Engagement elements, whose radial movement is blocked in a locking position of an actuating ring and whose radial movement is released in a release position of the actuating ring, are known in connection with coupling arrangements that form connecting devices for conduit sections of conduits for liquid or gaseous media or for conduits for conducting electric current or light. An example for a fluid coupling arrangement of this kind is disclosed in DE 199 15 291 A1. In such coupling devices, the medium to be conveyed passes through the two coupling parts to be connected to one another.

SUMMARY OF THE INVENTION

It is an object of the present invention to provide a vacuum cleaner of the aforementioned kind with an improved attachment for the filter such that the filter can be easily exchanged while a reliable attachment of the filter can be achieved.

In accordance with the present invention, this is achieved in that the vacuum cleaner has an exchangeable filter that is arranged within a receiving area of the vacuum cleaner housing wherein the filter has a through opening through which for attachment of the filter a holding arm extends that is secured with its upper end on the vacuum cleaner housing and/or on the vacuum cleaner motor and whose lower end is detachably connectable to a fasting member for attaching the filter. The holding arm in the area of its lower end has a radial recess that is engaged in the attached state of the filter by engagement elements of the fastening member. The engagement elements block removal of the fasting member from the lower end of the holding arm. An actuation ring of the fastening member is adjustable between a locking position, in which the engagement elements of the fasting member are secured against removal from the holding arm, and a release position, in which the fasting member can be pulled off the holding arm.

For exchanging the filter, in a device according to the invention the actuating ring of the fastening member is moved into its release position so that the fastening member can be pulled off the holding arm. Advantageously, this process can be performed with one hand. The attachment of a new filter can also be performed easily by means of the present invention: after pushing the filter onto the holding arm, the fastening member is pushed onto the lower end of the holding arm until the engagement elements lock in the radial recess. In preferred embodiments of the invention, no manual adjustment of the actuating ring into its release position is required so that the attachment of the fastening member at the lower end of the holding arm can be advantageously performed with one hand.

In an advantageous embodiment of the invention, the lower end of the holding arm is formed by a pin that is provided with the recess that extends circumferentially about the pin. The pin, in the fastened state of the filter, is inserted into an insertion sleeve of the fastening member and is locked therein by the engagement elements; the actuating ring surrounds the insertion sleeve.

Further advantages and details of the invention will be explained in the following with the aid of embodiments illustrated in the drawings; further objects of the invention will also be apparent from the illustrated embodiments.

BRIEF DESCRIPTION OF THE DRAWING

In the drawing:

FIG. 2 is a side view of the holding arm penetrating the central through opening of the filter;

FIG. 5 is a perspective view of the actuating ring;

DESCRIPTION OF THE PREFERRED EMBODIMENTS

Figure 1:
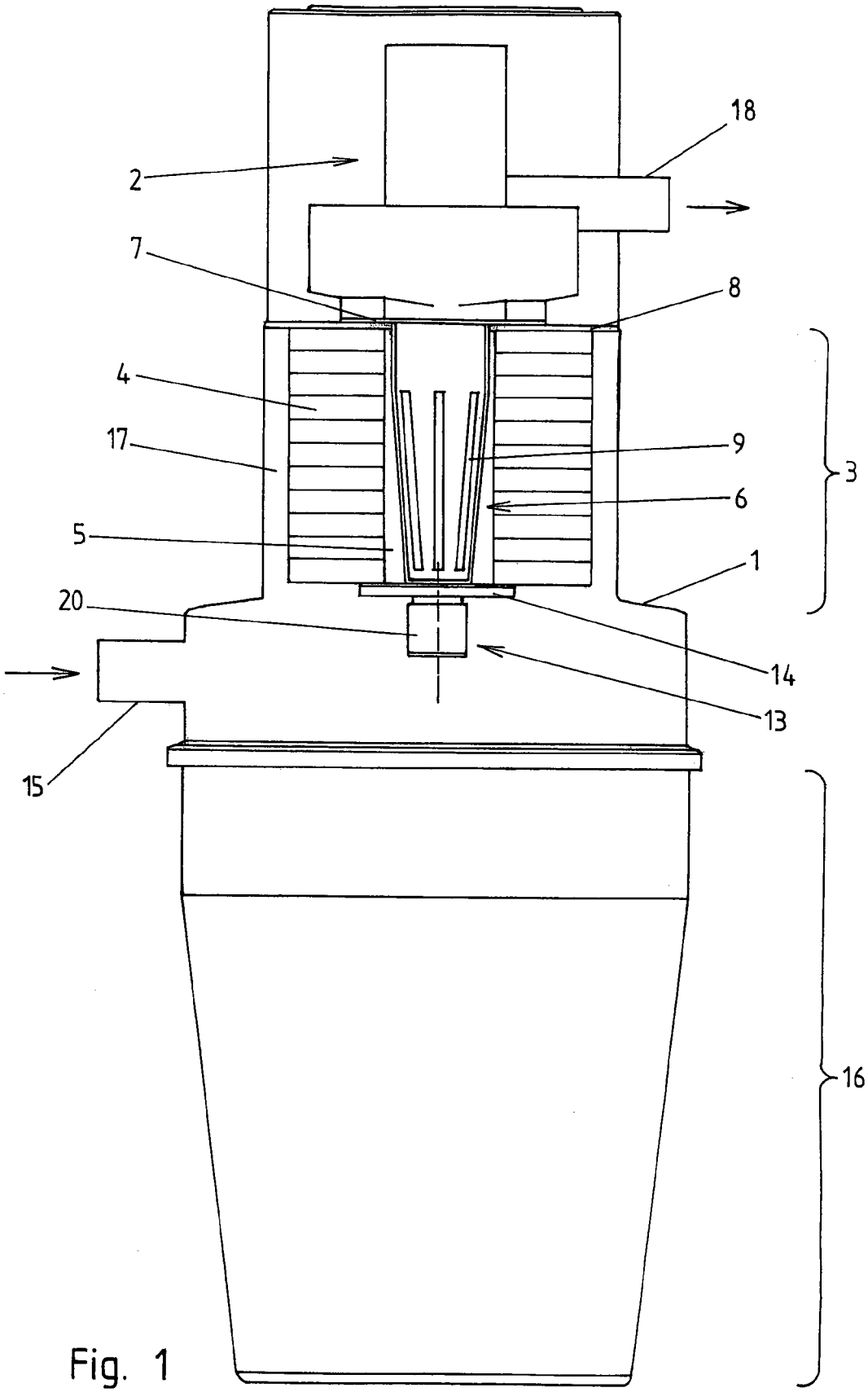
FIG. 1 is a schematic illustration of an embodiment of a vacuum cleaner comprising a fastening device according to the invention for attachment of the filter.

The vacuum cleaner illustrated schematically in FIG. 1 is a central vacuum cleaning device. The invention could also be used, for example, in connection with an industrial vacuum cleaner. The vacuum cleaner has a vacuum cleaner housing 1 in which the vacuum cleaner motor 2 is arranged. In a receiving area 3 of the vacuum cleaner housing 1 a filter 4 is arranged which is an exchangeable cartridge. The filter 4 has a central, axially extending through opening 5 through which a holding arm 6 extends that is secured with its upper end to the vacuum cleaner motor 2 and/or to the vacuum cleaner housing 1. In the illustrated embodiment the holding arm is attached with its upper end to a support plate 7 that is positioned between a partition 8 of the vacuum cleaner housing 1 and the vacuum cleaner motor 2.

The holding arm 6 is configured along most of its length as a sleeve or tube wherein its outer wall is provided with openings or slots 9. The lower end section of the holding arm 6 is formed by a pin 10 that is screwed into a lower boundary wall 11 of the sleeve-shaped or tubular section of the holding arm 6. In the attached state of the filter 4, the pin 10 is inserted into an insertion sleeve 12 of a fastening member 13 and locked therein (compare FIG. 3). A securing plate 14 of the fastening member 13 is thus pressed against the bottom side of the filter 4 in the area about its through opening 5 so that the upper end of the filter 4 is forced against the partition 8 and the filter 4 is fastened within the receiving area 3 of the housing 1. The upper and lower ends of the through opening 5 are essentially airtightly closed off by the partition 8 and the securing plate 14.

The dust-laden air is sucked in by the vacuum cleaner motor 2 through the suction socket 15. In the area of the vacuum cleaner housing 1 into which the suction socket 15 opens a known cyclone device can be arranged; such a cyclone device is not illustrated in detail and is not part of the present invention. The dust that has been separated from the sucked-in air is collected in the collecting area 16 of the vacuum cleaner housing 1. The air that has been sucked in by the vacuum cleaner motor 2 reaches the intermediate space 17 between the vacuum cleaner housing 1 and the filter 4 and flows farther through the filter 4 into the through opening 5 of the filter 4 and through the slots 9 of the holding arm 6 into the interior of the sleeve-shaped section of the holding arm 6. From the interior, the air flows through the outlet opening penetrating the support plate 7 into the vacuum cleaner motor 2 and then exits through the outlet socket 18 of the vacuum cleaner motor 2.

Figure 3:
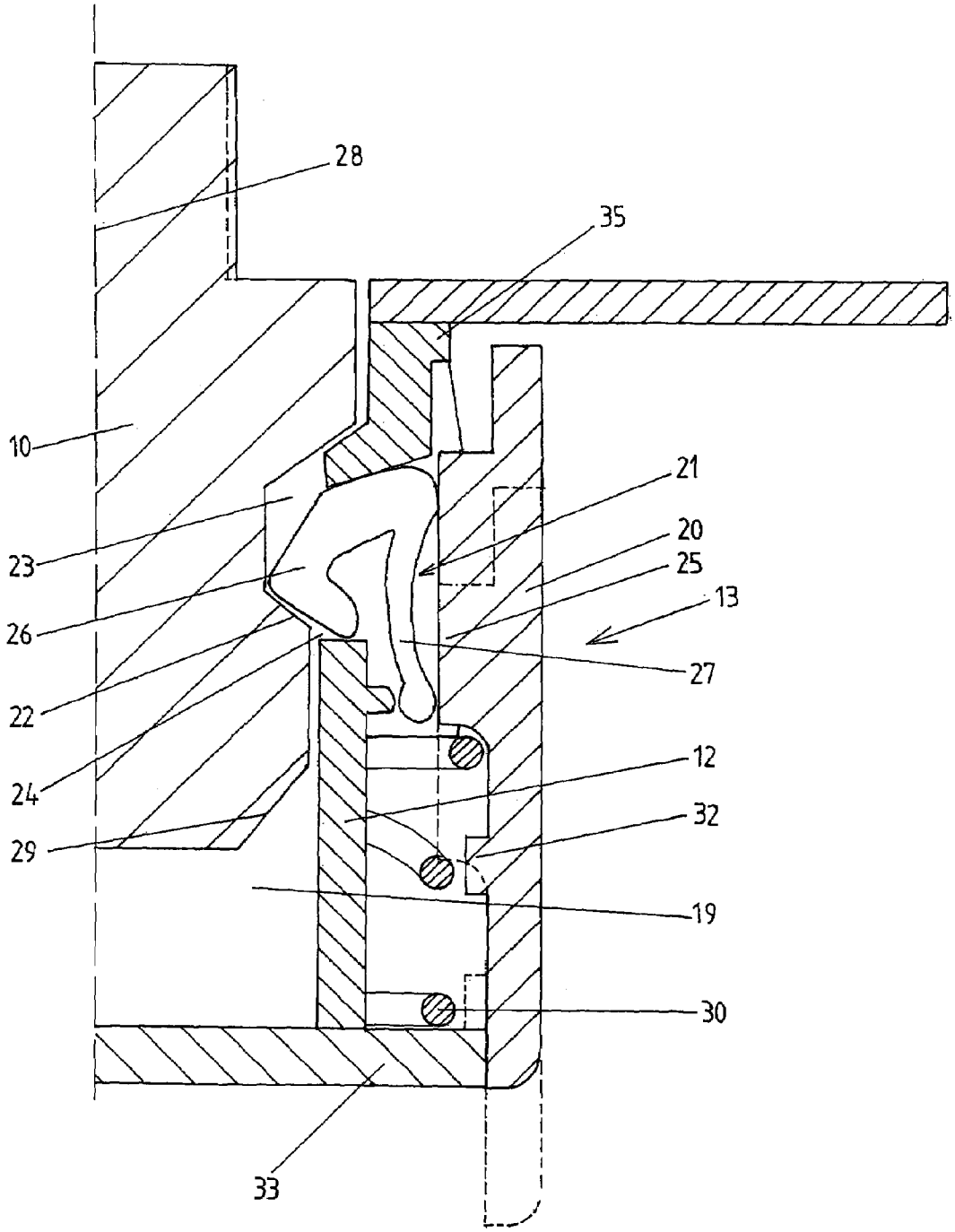
FIG. 3 is an axial section view of the fastening member and the pin forming the lower end section of the holding arm.
Figure 4:
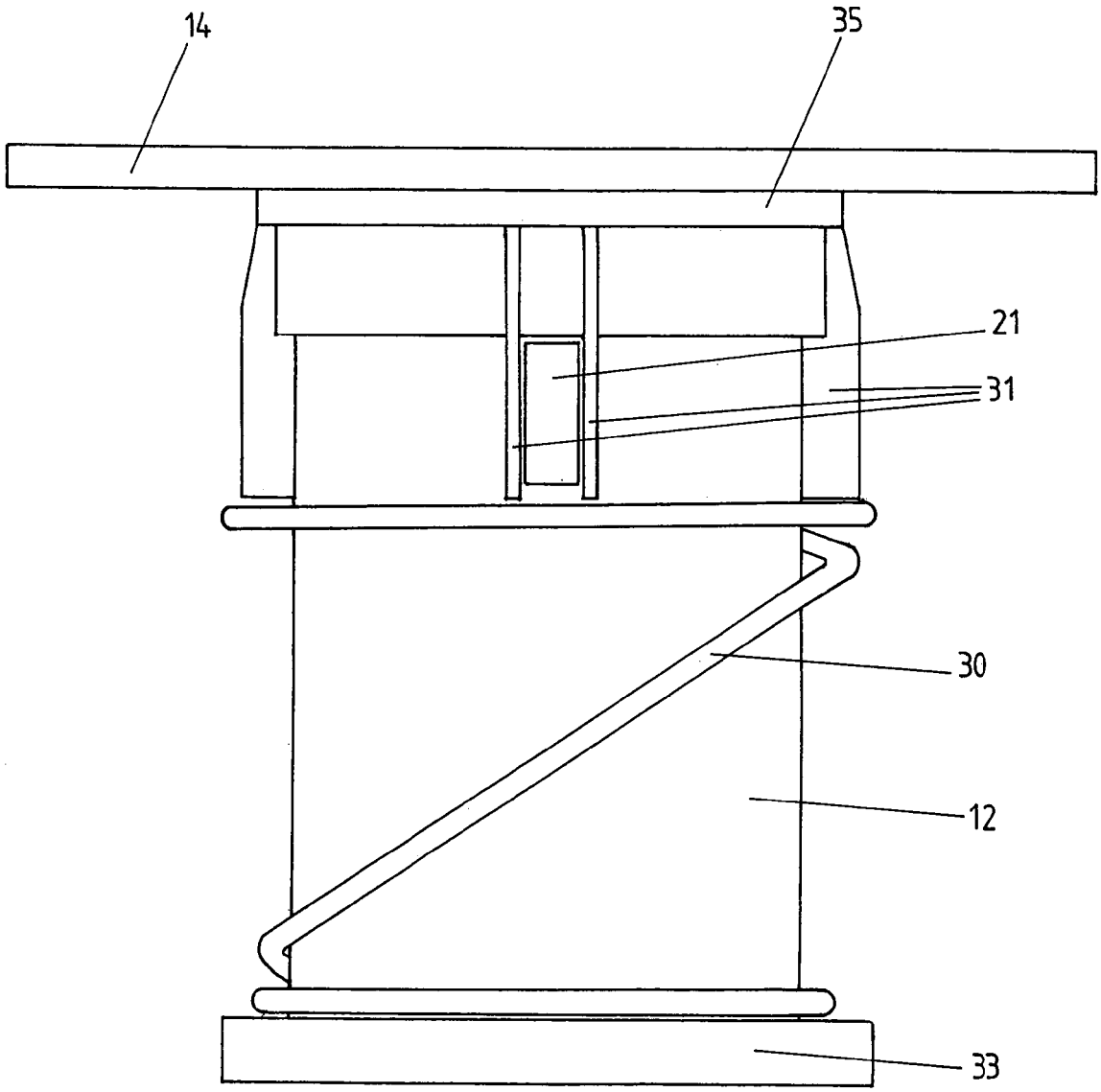
FIG. 4 is a side view of the insertion sleeve of the fastening member.

The configuration of the fastening member 13 and its connection to the pin 10 will be explained in the following in more detail with the aid of FIGS. 3 to 5. The fastening member 13 comprises the already mentioned insertion sleeve 12 that surrounds a receiving space 19 for the pin 10. The insertion sleeve 12 is surrounded by an actuating ring 20. The fastening member 13 has also engagement elements 21 that, in the state illustrated in FIG. 3, engage a radial recess 22 of the pin 10 (see illustration in FIG. 3). The radial recess 22 in this embodiment is formed by a sidewall of a depression 23 that annularly surrounds the pin 10 and is groove-shaped. In the illustrated embodiment, four engagement elements 21 are present which are spaced apart from one another by 90°, respectively, in the circumferential direction. Also,. more or fewer engagement elements 21 can be provided. The engagement elements 21 penetrate a window 24 in the insertion sleeve 12, respectively. In the locking position of the actuating ring 20 shown in FIG. 3, a radially inwardly extending projection 25 of the actuating ring 20 is positioned radially outwardly of the engagement elements 21 so as to cover them across their entire axial extension and locks them against radial displacement out of the depression 23 of the pin 10.

Starting from the locking position in which the ring 20 blocks the engagement elements 21 with regard to a radial displacement out of the depression 23 and a removal of the fastening member 13 from the holding arm 6, the actuating ring 20 is movable into a release position in which the engagement elements 21 are released to allow a radial, outward movement and in which the fastening member 13 can be removed from the holding arm 6. In FIG. 3, the actuating ring 20 is illustrated also in its release position in dashed lines. In the release position, the radial projection 25 of the actuating ring 20 is positioned below the upper sections of the engagement elements 21 so that they can be moved radially outwardly with their upper sections wherein at the same time a tilting of the engagement elements 21 about an axis that is positioned perpendicularly to the longitudinal axis 28 of the fastening member 13 takes place so that the engagement elements 21 are now positioned radially outwardly of the area of the recess 22.

The engagement elements 21 have in the illustrated embodiment a spring-elastic locking arm 26 that extends inwardly from a base plate 27 through a window 24. The locking arm 26 extends at a slant to a plane that is perpendicular to the longitudinal axis 28 of the fastening member 13; the locking arm 26 is facing away from the insertion side of the insertion sleeve 12. With this configuration, the locking arm 26 cannot be pushed radially out of the recess 22 in the locking position of the actuating ring 20 when a pulling force is acting on the fastening member 13 and the pin 10 that pulls them apart. On the other hand, when inserting the pin 10 into the insertion sleeve 12, the locking arm 26 can be pushed by means of a slant 29 located at the leading end of the pin 10 in an outward direction without the actuating ring 20 having to be moved into its release position.

The actuating ring 20 is pretensioned into its locked position by a spring 30 in the form of a spiral spring. In this embodiment, the adjustment of the actuating ring 20 between its locked position and its release position is realized by an axial displacement of the actuating ring 20. The axial guiding of the actuating ring 20 is realized by stays 31 that extend on opposed sides of a engagement element 21, respectively, in the axial direction. The stays 31 project radially outwardly from the insertion sleeve 12 and also serve for guiding the engagement elements 21. The projections 25 are guided between these stays 31.

In the illustrated embodiment, stops for limiting the axial displacement of the actuating ring 20 are formed by inwardly extending projections 32 that rest against the edge of the radially outwardly projecting bottom 33 of the insertion sleeve 12 in the release position and are also formed by stop projections 34 that, in the locked position, rest against an outwardly projecting collar 35 of the insertion sleeve 12. The collar 35 is arranged at the insertion side of the insertion sleeve 12. The securing plate 14 can be attached to the insertion sleeve 12 or can simply be resting loosely on it.

In the illustrated embodiment, the actuating ring is slidable for adjustment between its locked position and its release position only in the axial direction of the insertion sleeve 12 relative to the insertion sleeve. It is however also conceivable and possible that first a rotation of the actuating ring about the longitudinal axis of the insertion sleeve is. required before the axial displacement of the actuating ring for releasing the locking action can be realized. Such a displacement of the actuating ring is disclosed, for example, in the introductory portion of the aforementioned reference DE 199 15 291 A1 in connection with fluid coupling devices.

It is also conceivable and possible, but less preferred, to provide the adjustment of the actuating ring between its locked position and its release position only be means of rotation of the actuating ring about the longitudinal axis of the insertion sleeve.

Figure 6:
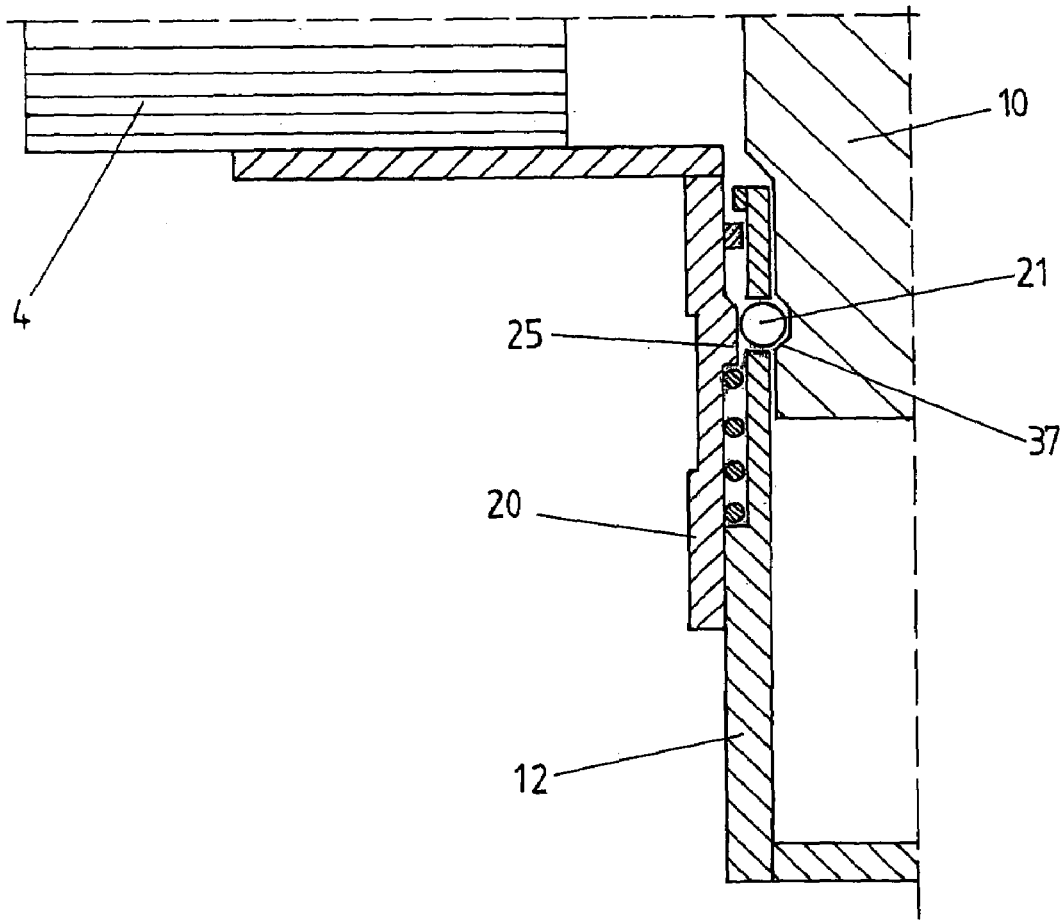
FIG. 6 is a schematic illustration of another embodiment of the invention.

In place of the described engagement elements, engagement elements of different configurations are conceivable and possible. For example, in the embodiment according to FIG. 6, spherical engagement elements 21 are used. The actuating ring 20 has a radially inwardly extending projection 25 that, in the locking position of the actuating ring 20, blocks a displacement of the engagement elements 21 in a radial outward direction and secures the engagement elements 21 in the groove-shaped depression 23 of the pin 10. Removal of the pin 10 from the insertion sleeve 12 is therefore blocked. After displacement of the actuating ring 20 into its release position (in the direction of arrow 36) the engagement elements 21 can move radially outwardly. When exerting a pulling force onto the pin 10, the engagement elements 21 are pushed out of the depression 23 by the slantedly positioned flank 37 of the pin 10. In this embodiment, the actuating ring 20 must be moved into its release position for inserting the pin 10 into the insertion sleeve 12 and for locking the pin 10 in the sleeve 12.

Figure 7:
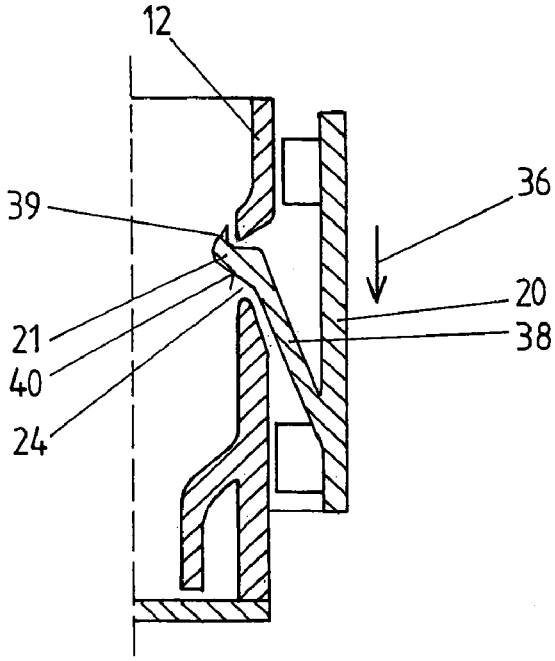
FIG. 7 is a schematic illustration of yet another embodiment of the invention.

A further possible embodiment is illustrated in FIG. 7. The engagement elements 21, of which, for example, three or four are provided in the circumferential direction, are connected by means of spring-elastic arms 38 to the actuating ring 20. The engagement elements 21 that are connected to the ends of the arms 38 remote from the actuating ring 20 penetrate a window 24 in the insertion sleeve 12, respectively. In the locked position of the actuating ring 20 illustrated in FIG. 7, an axial projection 39 of each engagement element 21 engages the edge of the window 24 facing the insertion side; in this embodiment, the engaged edge of the window 24 projects somewhat radially inwardly. The pin to be inserted into the fastening member can be designed in the way described in connection with the embodiment illustrated in FIGS. 1 through 5. In the locked position of the actuating ring 20 the engagement elements 21 engaged the recess 22 of the pin 10 and are locked in this way against radial movement in the outward direction by the projection 39 engaging the edge of the window 24. When the actuating ring 20 is moved axially in the direction of arrow 36 into its release position, the engagement elements 21 are first axially moved until the projection 39 is in the axial area of the respective window 24; subsequently, the slanted surface 40 contacts the edge of the window 24 facing away from the insertion side so that the engagement element 21 is moved radially outwardly until the pin 10 can be pulled out of the insertion sleeve 12. At the same time, the arms 38 are tensioned so that after release of the actuating ring 20 the actuating ring 20 is moved back into the locked position.

Figure 8:
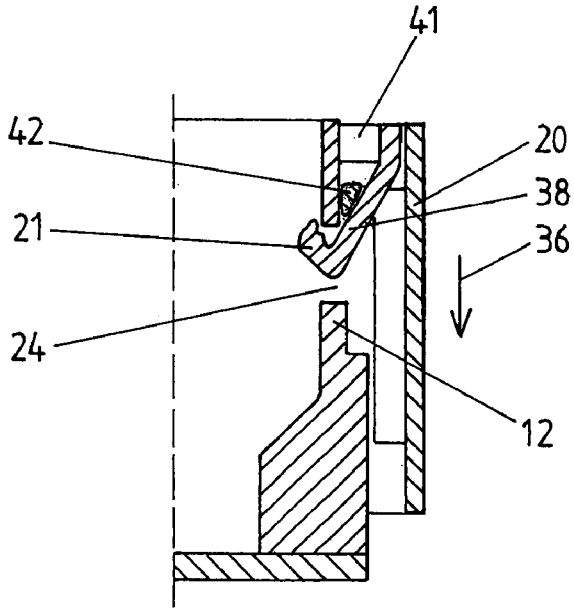
FIG. 8 is a schematic illustration of yet another embodiment of the invention.

In the embodiment according to FIG. 8, the engagement elements 21 are attached by means of arms 38 to an intermediate ring .41 that surrounds the insertion sleeve 12 in the area of the insertion side for the pin 10. The pin 10 can be designed again in the same way as illustrated in connection with FIGS. 2 and 3. The engagement elements 21 that are arranged on the ends of the arms extending, starting at the intermediate ring 41, in the insertion direction at an inward slant, penetrate again a window 24 of the insertion sleeve 12, respectively. In the locked position of the actuating ring 20 illustrated in FIG. 8, the engagement element 21 engages with its end facing away from arm 38 the edge of the window 24 that is positioned at the insertion side of the insertion sleeve 12. A wedge element 42 is arranged between the outer side of the insertion sleeve 12 and the arm 38, respectively, and is connected to the actuating ring 20. When moving the actuating ring 20 in the direction of arrow 36 into its release position, the intermediate ring 41 with the actuating elements 21 is moved approximately axially in the axial direction (arrow 36) so that the engagement elements 21 are positioned in the axial area of the windows 24; accordingly, the arms 38 are forced radially outwardly by the wedge elements 42 and the engagement elements 21 are moved radially outwardly.

In the embodiment according to FIG. 7 and FIG. 8, it is not required to first displace the actuating ring 20 manually into its release position for inserting the pin 10 into the insertion sleeve 12 and locking the pin 10 therein by means of the engagement elements 21.

Different further embodiments of the invention are conceivable and possible. For example, it would be conceivable and possible in principle to provide, instead of a recess on the pin 10 that extends slantedly relative to the insertion direction, a recess that is perpendicular to the insertion direction and interacts with a surface of the engagement elements extending perpendicularly to the insertion direction, respectively. A radial locking of the displacement of the engagement elements in the locked position of the actuating ring would therefore be obsolete. The release of the pin would be achieved in that the actuating elements upon movement of the actuating ring are pulled radially outwardly until they no longer engage the recess on the pin.

As is apparent from the above description, the range of the invention is not limited to the illustrated embodiments but is to be determined with reference to the attached claims in combination with the full range of possible equivalents.

While specific embodiments of the invention have been shown and described in detail to illustrate the inventive principles, it will be understood that the invention may be embodied otherwise without departing from such principles.

What is claimed is:

1. A vacuum cleaner comprising:

a vacuum cleaner housing having a receiving area;

a vacuum cleaner motor arranged in the vacuum cleaner housing;

an exchangeable filter arranged in the receiving area of the vacuum cleaner housing, wherein the filter has a through opening;

a holding arm having an upper end connected to at least one of the vacuum cleaner housing and the vacuum cleaner motor and penetrating the through opening of the filter;

a fastening member detachably connected to a lower end of the holding arm for securing the filter to the holding arm;

wherein the lower end of the holding arm has a radial recess;

wherein the fastening member has engagement elements engaging the radial recess when the filter is secured in a fastened state on the holding arm, wherein the engagement elements block removal of the fastening member from the lower end of the holding arm;

wherein the fasting member has an actuating ring that is moveable between a locked position, in which the engagement elements secure the fastening member against removal from the holding arm, and a release position, in which the fastening member is removable from the holding arm.

2. The vacuum cleaner according to claim 1, wherein the engagement elements in the locked position of the actuating ring are blocked to prevent radial displacement of the engagement elements and in the release position of the actuating ring are released by the actuating ring to allow radial displacement of the engagement elements.

3. The vacuum cleaner according to claim 1, wherein the engagement elements in the locked position of the actuating ring are blocked to prevent radial displacement of the engagement elements and in the release position of the actuating ring are radially moved by the actuating ring relative to a radial position of the engagement elements in the locked position of the actuating ring.

4. The vacuum cleaner according to claim 1, wherein the lower end of the holding arm is a pin, wherein the radial recess extends circumferentially about the pin, wherein the fastening member has an insertion sleeve, and wherein the pin, when the filter is in the fastened state on the holding arm, is inserted into the insertion sleeve of the fastening member and is locked in the insertion sleeve by the engagement elements.

5. The vacuum cleaner according to claim 4, wherein the actuating ring surrounds the insertion sleeve.

6. The vacuum cleaner according to claim 4, wherein the radial recess is a circumferentially extending groove-shaped depression.

7. The vacuum cleaner according to claim 4, wherein the insertion sleeve has windows that are penetrated by the engagement elements.

8. The vacuum cleaner according to claim 7, wherein the engagement elements each have a spring-elastic locking arm and a base plate to which the locking arm is connected, wherein the locking arm projects from the base plate and extends through the window of the insertion sleeve, respectively, wherein the locking arm extends at a slant to a plane extending perpendicularly to a longitudinal axis of the fastening member and is facing away from an insertion side of the insertion sleeve.

9. The vacuum cleaner according to claim 4, wherein the engagement elements are moveable by the actuating ring in an axial direction of the fastening member, wherein the engagement elements in the locked position of the actuating ring are locked by a radially extending stationary section of the fastening member against radial movement of the engagement elements and in the release position of the actuating ring are released by the radially extending stationary section of the fastening member to allow radial movement of the engagement elements, and wherein the radially extending stationary section of the fastening member that blocks in the locked position of the actuating ring the engagement elements against radial movement is formed by the insertion sleeve.

10. The vacuum cleaner according to claim 9, wherein the radially extending stationary section of the fastening member is formed by edges of windows of the insertion sleeve, wherein the windows are engaged by the engagement elements in the locked position of the actuating ring.

11. The vacuum cleaner according to claim 9, wherein the engagement elements are connected to the actuating ring.

12. The vacuum cleaner according to claim 11, wherein the engagement elements are connected to the actuating ring by spring-elastic arms.

13. The vacuum cleaner according to claim 4, wherein, for adjusting the actuating ring between the locked position and the release position, the actuating ring is movable in the axial direction of the insertion sleeve relative to the insertion sleeve.

14. The vacuum cleaner according to claim 4, wherein, for adjusting the actuating ring between the locked position and the release position, the actuating ring is rotatable relative to the insertion sleeve about a longitudinal axis of the insertion sleeve.

15. The vacuum cleaner according to claim 4, wherein, for adjusting the actuating ring between the locked position and the release position, the actuating ring is movable in the axial direction of the insertion sleeve relative to the insertion sleeve and rotatable relative to the insertion sleeve about a longitudinal axis of the insertion sleeve.

16. The vacuum cleaner according to claim 1, wherein the fastening member further comprises a spring that pretensions the actuating ring in the locked position.

17. The vacuum cleaner according to claim 1, wherein the fastening member has a securing plate that, in the fastened state of the filter, rests against a bottom side of the filter.

18. The vacuum cleaner according to claim 1, wherein the holding arm is configured at least about most of a length of the holding arm as a tube, wherein an outer wall of the tube has openings.

19. The vacuum cleaner according to claim 1, wherein air sucked in by the vacuum cleaner motor is sucked in from an area radially outside of the filter into the through opening.

20. The vacuum cleaner according to claim 1, wherein the vacuum cleaner is a central vacuum cleaning device.

* * * * *